United States Patent [19]

Giblin et al.

[11] Patent Number: 4,981,256

[45] Date of Patent: Jan. 1, 1991

[54] ULTRATHIN CARTON CLOSURE

[75] Inventors: Edward J. Giblin, Pompton Lakes; John A. Hockey, Ridgewood; James M. Gleason, Basking Ridge, all of N.J.

[73] Assignee: Lever Brothers Company, New York, N.Y.

[21] Appl. No.: 496,165

[22] Filed: Mar. 19, 1990

Related U.S. Application Data

[63] Continuation of Ser. No. 369,432, Jun. 21, 1989, abandoned.

[51] Int. Cl.[5] ..... B65D 5/74

[52] U.S. Cl. ..... 229/125.09; 229/125.14; 229/160.2; 229/917

[58] Field of Search ..... 229/125.08, 125.09, 229/125.14, 125.17, 123.3, 917, 160.2; 220/259

[56] References Cited

U.S. PATENT DOCUMENTS

| | | | |
|---|---|---|---|
| Re. 21,310 | 12/1939 | Mackey . | |
| D. 304,300 | 10/1989 | Duke . | |
| 2,107,614 | 2/1938 | Kotcher et al. | 229/125.09 |
| 2,146,226 | 2/1939 | Punte . | |
| 2,170,614 | 8/1939 | Allen . | |
| 2,282,318 | 5/1942 | Biggs . | |
| 2,321,050 | 6/1943 | Seymer . | |
| 2,417,550 | 3/1947 | Guyer . | |
| 2,775,338 | 12/1956 | Schmalzried . | |
| 2,847,151 | 8/1958 | Meyer-Jagenberg . | |
| 2,946,496 | 7/1960 | Stagmeier . | |
| 3,018,024 | 1/1962 | Foord . | |
| 3,081,005 | 3/1963 | O'Connor . | |
| 3,217,951 | 11/1965 | Paal . | |
| 3,250,436 | 5/1966 | Kurtz | 229/125.15 |
| 3,281,024 | 10/1966 | Henchert et al. . | |
| 3,323,671 | 6/1967 | Minarik et al. . | |
| 3,419,198 | 12/1968 | Pettersen . | |
| 3,424,338 | 1/1969 | Kazel . | |
| 3,951,331 | 4/1976 | Smith et al. . | |
| 4,108,330 | 8/1978 | Patterson . | |
| 4,164,303 | 8/1979 | Waterbury . | |
| 4,189,060 | 2/1980 | Trotman, III . | |
| 4,258,876 | 3/1981 | Ljungerantz . | |
| 4,407,424 | 10/1983 | Heyn . | |
| 4,473,168 | 9/1984 | Cox . | |
| 4,516,689 | 5/1985 | Barker . | |
| 4,582,216 | 4/1986 | Byrd . | |
| 4,732,315 | 3/1988 | Gunn . | |
| 4,770,325 | 9/1988 | Gordon et al. . | |
| 4,775,098 | 10/1988 | Peer et al. . | |
| 4,781,323 | 11/1988 | Elias et al. . | |
| 4,782,996 | 11/1988 | Spahni et al. . | |
| 4,807,787 | 2/1989 | Langmeier et al. . | |
| 4,830,273 | 5/1989 | Kalberer et al. . | |
| 4,852,764 | 8/1989 | Stone | 229/125.09 |
| 4,858,793 | 8/1989 | Stone | 229/125.09 |

FOREIGN PATENT DOCUMENTS

| | | | |
|---|---|---|---|
| 504012 | 4/1939 | United Kingdom | 229/125.09 |

*Primary Examiner*—Gary E. Elkins

*Attorney, Agent, or Firm*—Gerard J. McGowan, Jr.

[57] ABSTRACT

A plastic closure for cartons which permits controlled dispensing of product. The closure is a fitment comprised of a thin material which is of such a minimal thickness that it does not tend to cause uneven stacking of the cartons when they are in flattened form, prior to their erection. The closure is generally thin enough to be accommodated within a carbon having either a 3- or 4- point rule score and normal score caliper balancing. The closure comprises a base member having an aperture, and a cover member which has a depending plug which fits within the aperture of the base when the cover member is in the closed position.

36 Claims, 4 Drawing Sheets

FIG. 1
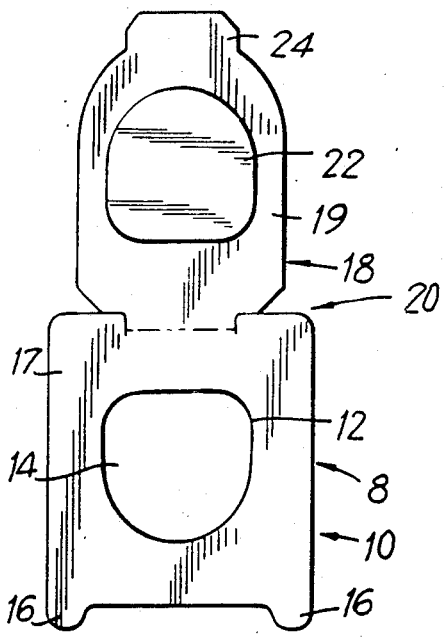
FIG. 2
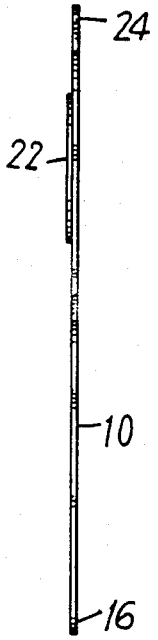
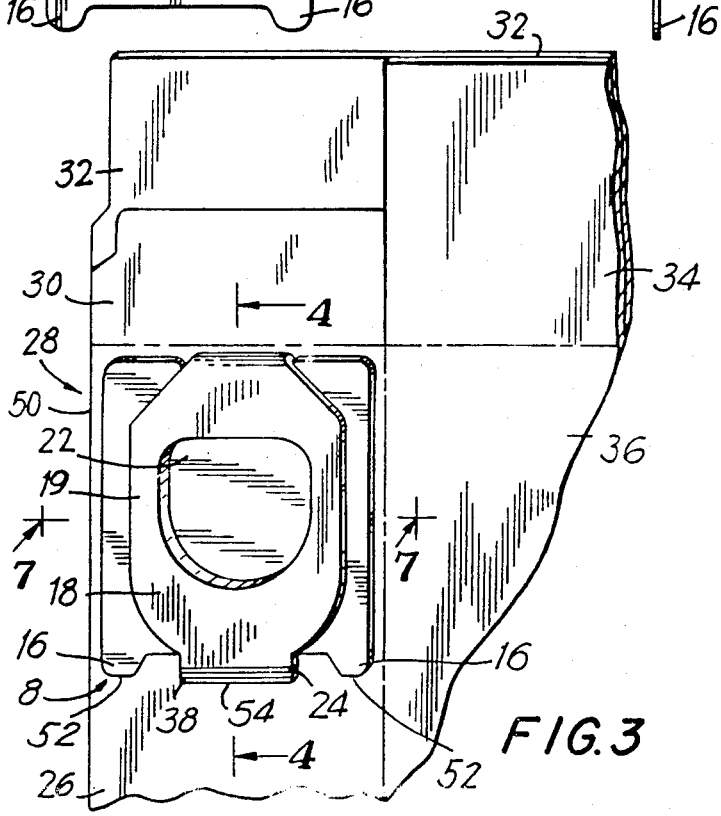
FIG. 3

ULTRATHIN CARTON CLOSURE

This is a continuation of Ser. No. 369,432, filed June 21, 1989, now abandoned.

BACKGROUND OF THE INVENTION

Powdered laundry detergents have typically been provided in cartons fabricated from paperboard. While cartons have many acceptable properties, difficulties have sometimes been encountered in pouring product therefrom. Cartons have often been provided with die-cut perforations in the paperboard along which the consumer makes an opening in the carton. Frequently, however, consumers find it difficult to rupture the perforations so as to open the carton. Moreover, once an opening in the carton has been made it is often difficult to control the product during pouring due to the irregular shape of the pouring aperture created by the consumer. Furthermore, openings formed in the paperboard are usually not reclosable. As a result, a tendency exists for the product to spill undesirably from the carton if tipped, and especially during transport. Moreover, products which are sensitive to moisture pick-up tend to cake because of the exposed opening.

Recently, attempts have been made to solve the aforementioned problems through the use of plastic fitments. Plastic fitments have been proposed which can be adhesively attached to the carton. It is generally desirable for detergent manufacturers that the fitment be affixed when the paperboard carton is in a flat, tubular form prior to erection of the carton. However, according to Gunn U.S. Pat. No. 4,732,315, when a thin, plastic fitment is affixed to the carton in its flat, tubular form problems may arise during stacking of the tubes due to an imbalance in the otherwise flat cartons caused by the extra thickness of the fitment. Gunn discloses a plastic closure device having an aperture configured in a pentagonal, "home plate" shape said to have rounded corners, which is balanced by means integral with the carton. For instance, the means may comprise score lines which are thickened to offset the extra thickness of the fitment. The tapered pointed end of Gunn's fitment is said to assist in properly directing the product stream.

Another recent patent, Peer et al. U.S. Pat. No. 4,775,098 illustrates a circular plastic closure fitting within a circular aperture in the carton. However, it would appear to be difficult to insert accurately the circular closure within the circular aperture on a regular basis. Moreover, apertures of that shape fail to provide the product being poured with adequate guidance for controlled dispensing. Langmeier et al. U.S. Pat. No. 4,807,787 describe a thermoplastic, reclosable device said to permit easy opening of containers. The device includes a base having an aperture and a moveable portion having a plug of a shape complementary to the aperture. The base and the moveable portions may be connected by a hinge. The aperture provided therein is somewhat oval.

Spahni et al. U.S. Pat. No. 4,782,996 discloses cartons having fitments and an extra cutout to accommodate the thickness of the fitment when the carton is in its flattened, tubular form. Mackey U.S. Pat. No. Re 21,310 discloses a container having a spout, the cover of which is fabricated from a very thin metal on the order of 1/1000 of an inch. The thickness of the cover and the construction of the container are such that the spout is said not to interfere with stacking or labeling of the containers.

Barker U.S. Pat. No. 4,516,689 is directed to an easy open/reclosable container which may be made from thermoformed K-resin(®). An aperture in the container is characterized as "tear-shaped." In one embodiment, the pouring/reclosing device is attachable to a container top lid and comprises a base and a movable portion which sealingly enters the apertures in the base and the container lid. Seymer U.S. Pat. No. 2,321,050 discloses a hinged plug closure for a container. The closure unit is preferably formed from a fibrous blank of material similar to that of the carton. The closure includes a top layer and a underlayer.

SUMMARY OF THE INVENTION

The present invention is directed to a plastic closure for cartons which provides for controlled dispensing of product by the consumer yet admits of convenient manufacture and does not tend to cause an imbalance in the cartons when they are stacked in flat, tubular form. The fitment of the invention comprises a base member having an aperture, which is preferably teardrop-shaped, and a cover member which has a depending plug which is similarly shaped. A U-shaped aperture may be selected particularly when the closure is attached to the carton sidewall. The cover member moves between an open position and a closed position by means of a dead-fold hinge in which the plug fits sealingly within the teardrop or other-shaped aperture of the base.

In accordance with the invention, the closure is comprised of an thin material, preferably plastic, which is of such a minimal thickness that it does not tend to cause uneven stacking of the flat cartons to which it is affixed. The fitment is generally thin enough to be accommodated within a carton with either a 3- or 4-point rule score and normal score caliper balancing so that no additional balancing means need be added. Preferably, the plug extends completely through the aperture in the base, but does not extend past one carton layer, e.g., one layer of paperboard, when the closure is in the closed position. The thickness of the plastic or other material from which the closure is fabricated ideally ranges from 0.013 inches to 0.02 inches. Increased plastic thickness of e.g., 0.022 inches may be appropriate in certain cases. For a normal 4 point rule-scored carton, the plastic thickness will be 0.018 inches to 0.020 inches and the thickness of the fitment plug below the base is 0.05 to 0.055 inches. For a normal 3 point rule-scored carton, the thickness of the fitment's plastic will be approximately 0.015 inch and the thickness of the plug below the base would be about 0.045 inch. Generally, the overall thickness of the fitment will range from 0.06 to 0.09 inches and corresponds to the thickness of the plug.

BRIEF DESCRIPTION OF THE DRAWINGS

FIG. 1 is a top plan view of the fitment of the invention in its open position.

FIG. 2 is a side elevation of the fitment of FIG. 1.

FIG. 3 is a perspective view of a folded tubular carton having a closed fitment of the invention affixed thereto.

DETAILED DESCRIPTION OF THE INVENTION

Figure 4:
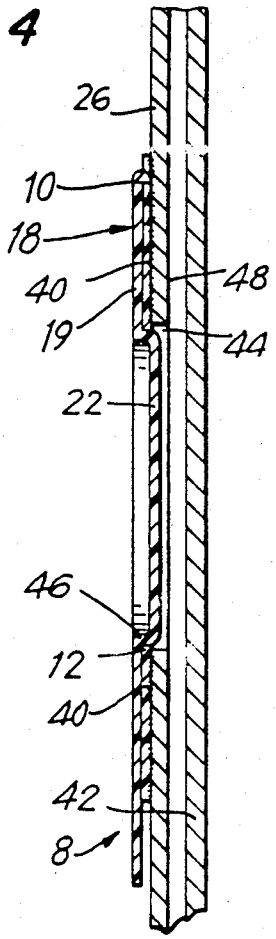
FIG. 4 is a cross section of the fitment and carton of the invention along the lines 4—4 of FIG. 3.

Referring to FIG. 1, the fitment or closure 8 of the invention comprises a base 10 having centrally disposed therein a wall 12 defining an aperture 14 surrounded by base peripheral flange 17. Two arms 16 extend from the bottom of the base at either side. A cover member 18 is hingedly associated with the base. Preferably, hinge 20 is of the deadfold type so as to permit the cover member to stay open during pouring of product, as will be described in more detail herein below. Cover member 18 includes a plug 22 formed therein disposed centrally within the cover member and a cover peripheral flange 19 surrounding the plug. The cover member also includes a lift tab 24 to permit the consumer to grasp the cover member easily when opening the fitment.

Fitment 8 is made of a thin sheet material, preferably a plastic such as glycol-modified polyethylene terephthalate (PETG). The thickness of the material from which the fitment is fabricated preferably ranges from 0.013 to 0.02 inches. That is, the base member and the cover member (excluding the plug) preferably are each of this thickness. The thermoformed plug thickness below the base is preferably 0.025 to 0.055 inches. Overall, the total thickness of the fitment when the cover member is sealingly fitted within the aperture of the base member (i.e. when the fitment is closed) is generally from 0.06 inches to 0.09 inches. This corresponds to the total thickness of the plug which is the thickest portion of the fitment.

Referring now to FIG. 3, the fitment of the invention is generally applied to the carton when the carton is in the flat tubular form prior to erection. In this state, the glue flap has been glued to one side of the carton and the carton is flattened in a tube. The ultrathin carton closure of the invention is of particular benefit when it is applied to the flattened tubular cartons since upon stacking of those cartons the lack of thickness of the closure avoids the uneven stacking which otherwise occurs with thicker closures.

As illustrated in FIG. 3, the fitment 8 is affixed to side panel 26 of the flat tubular carton 28. Of course, the fitment may instead be affixed to an end panel, especially top panel 34, if desired. The carton panels may be fabricated of any material usually used for such purpose. Paperboard, or paperboard laminated with one or more plastic layers, is particularly preferred. However, the carton panels may be plastic, per se, if desired. The fitment is affixed to the carton with any suitable means such as an aqueous-based cold adhesive or hot melt. In the flattened form of the carton, the side panel 26 is adjacent minor flap 30, which partially obscures inside major flap 32 in FIG. 3. Minor flap 30 is also adjacent to outside major flap 34. When the carton is in the flattened tubular form, outside major flap 34 is located above front panel 36.

Figure 5:
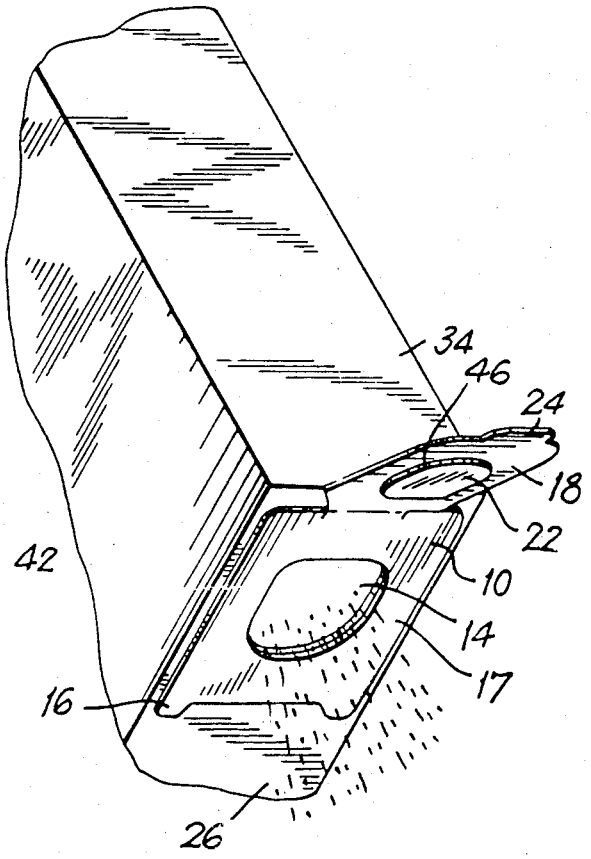
FIG. 5 is a perspective view of an erected carton having the fitment of the invention mounted on the side, wherein product is being poured therefrom.

The closure is operated by simply grasping the lift tab 24 and pulling it, whereby the cover member 18 is pulled from the base member and pivots along hinge 20. Since hinge 20 is a deadfold hinge, when the fitment is fully opened, the cover member remains in the open position while product is poured from the container, as shown in FIG. 5. Lift tab 24 may be provided with one or more fold lines or ridges 38 to facilitate the lifting of the cover member. The lift tab may be slightly folded upwards after initial usage to facilitate grasping.

The fitment is preferably made of a single piece. The relationships among the cover member of the fitment, the base member of the fitment, and the panel to which the fitment is affixed are seen particularly in FIG. 4. The base 10 is affixed to the panel 26 of the carton with a layer of adhesive 40. When the carton is in its flattened tubular form, panel 26 having fitment 8 affixed thereto, lies on top of rear panel 42. The outer wall 46 of the plug sealingly abuts wall 12 of the base member, which defines the base member aperture. Part of the outer wall 46 is inclined downwardly and inwardly so that it can be wedged sealingly against the wall 12 of aperture 14. Wall 46 of the plug does not abut panel 26. The fitment is partially accommodated within an aperture 44 within the panel 26, which aperture is larger than the plug. Outer wall 46 may include one or more beads which may extend most of the thickness of the plug wall or end short of the cover peripheral flange. Preferably these beads are situated at the V-shaped corner and at one or more positions along the top of the arc.

Figure 7:
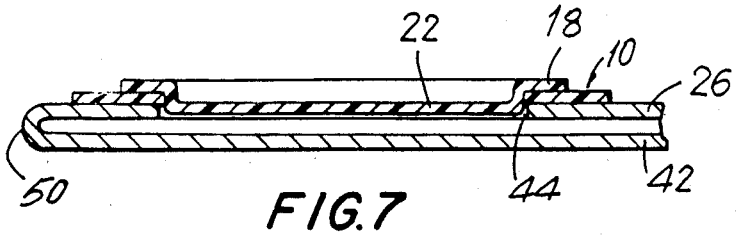
FIG. 7 is a cross section of the fitment of the invention taken along the lines 7—7 of FIG. 3.

In accordance with a particularly desirable feature of the invention, the plug of the fitment does not extend completely through the aperture 44 of the carton layer, but rather extends up to or even short of (as illustrated in FIG. 4) the plane defined by the inner wall 48 of panel 26. In this way, the fitment does not unduly add to the thickness of the carton. Indeed, as discussed below, the thickness of the carton at the fitment is quite close to and balanced by the thickness of the carton at the glue flap and rolled-down working scores. On a flattened carton with 4-point rule scores, the working scores on the side edges are normally rolled down (normal score caliper balancing) to 0.100 to 0.110 inches. Also, it is preferred that, as illustrated in FIGS. 4 and 7, the depth of the plug below the cover peripheral flange 19 does not exceed the total thickness of the base and of the carton layer to which it is affixed. This also serves to minimize the thickness of the carton at the fitment and keeps it balanced by the carton thickness at the glue flap and normal rolled-down working scores. As illustrated, when the closure is closed, the plug preferably extends completely through the aperture in the base to maximize sealing. The plug preferably extends past and through the base since the amount of thickness attributable to the base is intended to be minimal.

At the glue flap of a flattened tubular carton, there are three layers of carton thickness. One layer is the side panel to which the glue flap is adhered. The second is the glue flap, which generally extends from the panel which will constitute the rear panel of the erected carton. The third is the front major panel against which the glue flap will rest when the carton is flattened. In addition, there will be a thickness resulting from the adhesive used to glue the glue flap to the side panel of the carton. For a 31 point carton (i.e. a carton having layers of 0.031 inches each), a typical thickness at the glue flap would be 0.093 to 0.098 inches, that is, $3\times0.031$ representing the thickness of the three carton layers plus the thickness for a layer of adhesive adhering the glue flap to the side panel). When an ultrathin fitment according to the invention is used, The thickness of carton at the fitment can be the same or nearly the same as that at the glue flap and rolled-down working scores. Therefore, no balancing means are required.

Considering the cross section of FIG. 4, each of the layers 42 and 26 will account for approximately 0.031 inch thickness. The plug of the fitment is accommodated within the thickness of layers 26 and 42, the adhesive layer 40 and the fitment layers 18 and 10. Therefore, the fitment plug does not account for any additional thickness. The adhesive layer 40 accounts for approximately 0.005 inch thickness, the base member 12 accounts for, e.g., 0.018 inch thickness and the cover member 18 also would account for, e.g., 0.018 inch thickness. Again, the plug depth which may be 0.030 inch below the base would not be counted as it does not provide additional thickness. The total of 0.103 inch thickness at the fitment is roughly comparable to the thickness at the glue flap and working scores so that the fitment will not cause the carton to be unbalanced.

Figure 6:
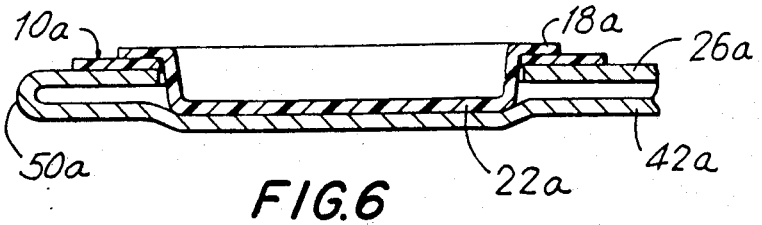
FIG.6 PRIOR ART
FIG. 6 is a cross section of a prior art fitment.
Figure 8:
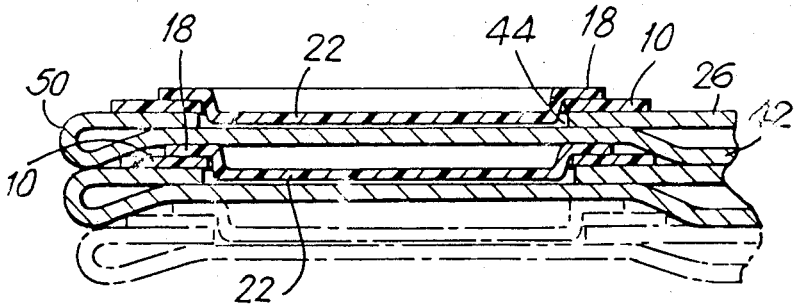
FIG. 8 is a cross section of several folded, tubular cartons having the fitment of the invention stacked upon each other.

The contrast between thick fitments not in accordance with the present invention and the present fitment can be seen particularly by comparing FIGS. 6 and 7. In FIG. 6, the plug 22*a* extends beyond the carton layer 26*a* and abuts the lower carton layer 42*a*. It will be appreciated that the depth of the plug illustrated in FIG. 6 will result in the plug itself accounting for an appreciable amount of thickness at the fitment, in contrast to the arrangement of FIG. 7 wherein the thickness of the plug is accommodated by the thickness of layer 26 so that the plug per se does not increase the overall thickness of the carton and the two thin layers of plastic account for the only additional thickness. As can be seen in FIG. 8, when the cartons of the present invention are in flattened tubular form and are stacked one on top of the other, the fitment thickness can be accommodated by the carton and it does not throw the carton out of balance. On a normal production line magazine, roughly 1500 to 2000 flattened cartons are stacked during operation.

When the fitment 8 is affixed to the side panel of the carton, it is adjacent to edge 50 of the flattened tubular carton as seen especially in FIGS. 3, 7, and 8.

Figure 9:
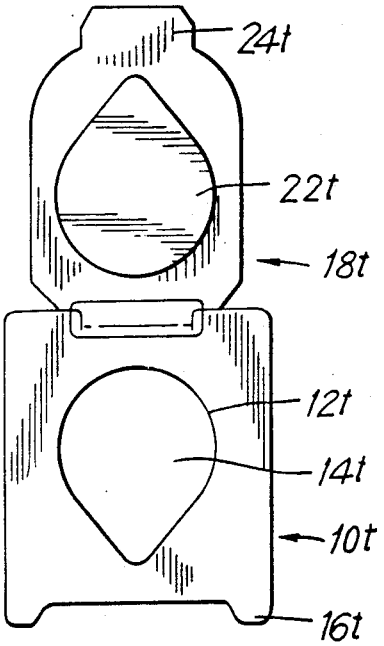
FIG. 9 is a preferred embodiment of the closure of the invention.
Figure 10:
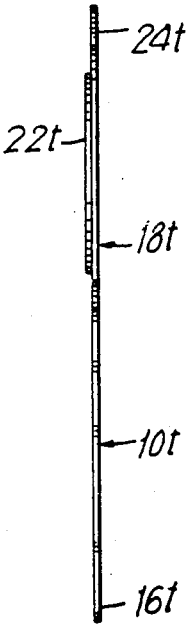
FIG. 10 is a side elevation of the closure of FIG. 9.

A preferred embodiment of the invention is illustrated in FIGS. 9 and 10 wherein the plug and fitment aperture take the shape of a teardrop and features corresponding to those previously described are given the same numbers, followed by a "t." The preferred teardrop shape of the fitment facilitates both its formation and its placement on the carton. The curved shape of the top of the teardrop aperture enables the thermoformer to prepare the fitment more easily than fitments having apertures with corners. Likewise, the curved shapes of the teardrop and the mating plug are believed to provide a better seal then components having squared shapes. Also, the curved top of the teardrop is believed to facilitate closure of the fitment by the consumer. The V-shaped bottom end of the teardrop-shaped aperture channels the product as it is poured to permit the consumer to maximize control. The teardrop comprises a top portion which includes at least 180 degrees of an arc, preferably an arc of a circle, and a bottom portion connecting the ends of said top portion with a generally V-shaped section.

The base 10 of the fitment of the invention is generally rectangular in outline, which eases the handling of the fitment by the machinery which places it on the carton. Moreover, the two arms 16 provided at the bottom of the base protect the lift tab from damage during shipment. As seen in FIG. 3, the distal or bottom edge 52 of each of the two arms and 54 of the lift tab 24 end in the same line so that the generally rectangular shape of the fitment is maintained and no parts project out in such a way as to interfere with handling of the fitment during manufacture. The fitment provides ample plastic base material surrounding the fitment aperture, which results in more area for the hot-melt or other adhesive means to adhere to the carton. The lift tab is centrally located on the cover member to facilitate opening thereof.

As illustrated in the drawings, the fitment is generally flat and is not an integral member of the carton. The area within the outer boundaries (outer edges) of the base and cover are generally similar. The area of the plane defined by the outer edges of the cover are generally from 60% to 140%, preferably 80% to 120%, of that of the base. The area of the aperture within the base is, of course, included for purposes of this calculation.

Typically, the fitments of the invention include a single aperture in the base in contrast to closures of the salt shaker-type, which often include a plurality of small apertures. Moreover, the base of the invention generally comprises a flat sheet. Since the base is generally glued or otherwise chemically adhered to the carton, it does not require a flange depending from the wall of the aperture such as the base of the fitment of Langemeier U.S. Pat. No. 4,807,787.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed is:

1. A plastic fitment having an overall thickness when closed of from 0.06 to 0.09 inches, comprising:

(a) a base member having an aperture centrally positioned therein, and (b) a cover member associated therewith so as to be movable between an open and a closed position and including a plug depending therefrom shaped to fit within the aperture, said depending plug fitting sealingly within said aperture when said cover member is in the closed position, the area within the outer boundaries of the cover being from 60 to 14O% that of the base.

2. The fitment according to claim 1 wherein the base member comprises a peripheral flange of plastic completely surrounding said aperture.

3. The fitment according to claim 1 wherein said cover member is hingedly associated with said base member.

4. The fitment according to claim 1 wherein said hinge is a deadfold hinge.

5. The fitment according to claim 1 wherein said cover member includes a lift tab disposed centrally within the fitment.

6. The fitment according to claim 5 wherein said lift tab includes a ridge along which said lift tab folds.

7. The fitment according to claim 5 wherein said base member includes two arms projecting from the bottom of said base on either side of said pull tab when said cover member is in the close position.

8. The fitment according to claim 7 wherein the respective bottom edges of said arms and said pull tab approximately fall within a single plane.

9. The fitment according to claim 1 wherein at least a portion of the outer walls of said plug extend downwardly and inwardly from said cover member whereby to fit sealingly within said aperture for detachably sealing said depending plug to said base member.

10. The fitment of claim 9 wherein the aperture and plug are shaped in the form of teardrops.

11. The fitment of claim 1 wherein the teardrop comprises a top portion which includes at least 180 degrees of an arc and a bottom portion connecting the ends of said top portion with a generally V-shaped segment.

12. The fitment of claim 1 wherein the cover member and the base member are formed of one piece.

13. The fitment of claim 1 wherein the fitment is made of glycol-modified polyethylene terephthalate(PETG) or polyethylene terephthalate (PET).

14. The fitment of claim 1 wherein the base member has a generally rectangular outline.

15. The fitment of claim 1 wherein the plastic from which the fitment is fabricated has a thickness of 0.013 to 0.02 inches and the plug thickness below the base is from 0.025 to 0.055 inches.

16. The fitment of claim 1 wherein the arc is an arc of a circle.

17. An erected carton having an aperture in its side or top panels and having affixed thereto the fitment of claim 1, said carton aperture being generally in alignment with said fitment aperture.

18. An erected carton having fastened to one of its ends or side panels a plastic fitment comprising:

(a) a base member having an aperture centrally positioned therein, and (b) a cover member associated therewith so as to be movable between an open and a closed position and including a plug depending therefrom which is shaped to fit within the aperture and surrounded by a cover peripheral flange, said depending plug fitting sealingly within and completely through said base aperture when said cover member is in the closed position, said plug not extending past the layer of the carton to which the fitment is affixed and the depth of said plug below said cover peripheral flange not exceeding the combined thickness of the base and the carton panel to which it is affixed.

19. The erected carton according to claim 18 wherein the base member comprises a flange of plastic completely surrounding said aperture.

20. The erected carton according to claim 18 wherein said cover member is hingedly associated with said base member.

21. The erected carton according to claim 18 wherein said hinge is a deadfold hinge.

22. The fitment according to claim 18 wherein said cover member includes a lift tab disposed centrally within the fitment.

23. The erected carton according to claim 22 wherein said lift tab includes a ridge along which said lift tab folds.

24. The fitment according to claim 22 wherein said base member includes two arms projecting from the bottom of said base on either side of said pull tab when said cover member is in the closed position.

25. The fitment according to claim 24 wherein the respective bottom edges of said arms and pull tab extend along approximately a single plane.

26. The erected carton according to claim 18 wherein the outer walls of said plug extend downwardly and inwardly from said cover member whereby to fit sealingly within said aperture.

27. The erected carton of claim 18 wherein the plug and the fitment apertures are shaped as teardrops.

28. The erected carton of claim 27 wherein the teardrop comprises a top portion which includes at least 180 degrees of an arc and a bottom portion connecting the ends of said top portion with a generally V-shaped segment.

29. The erected carton of claim 18 wherein the cover member and the base member are formed of one piece.

30. The erected carton of claim 18 wherein the fitment is made of glycol-modified polyethylene terephthalate (PETG) or polyethylene terephthalate (PET).

31. The erected carton of claim 18 wherein the base member has a generally rectangular outline.

32. The erected carton of claim 18 wherein said carton panel includes an aperture at least slightly larger than the teardrop-shaped aperture of said base and in alignment therewith.

33. The erected carton of claim 18 wherein the plastic from which the fitment is fabricated has a thickness of 0.013 to 0.02 inches and the plug thickness below the base is 0.025 to 0.055 inches.

34. The fitment of claim 1 wherein the total thickness of the closed fitment ranges from 0.06 inches to 0.09 inches.

35. A folded, tubular carton having fastened to one of its end or side panels a plastic fitment comprising (a) a base member having an aperture centrally positioned therein, and (b) a cover member associated therewith so as to be movable between an open and a closed position and including a plug depending therefrom which is shaped to fit within the aperture and surrounded by a cover peripheral flange, said depending plug fitting sealingly within and completely though said base aperture when said cover member is in the closed position, said plug not extending past the layer of the carton to which the fitment is affixed and the depth of said plug below said cover peripheral flange not exceeding the combined thickness of the base and the carton panel to which it is affixed.

36. A folded tubular carton comprising (a) one or more 3- or 4- point rule score lines and a glue flap which is a single layer adhered to a panel of the carton, (b) fastened to one of its end or side panels a plastic fitment comprising (i) a base member having an aperture centrally positioned therein and (ii) a cover member associated therewith so as to be movable between an open and a closed position and including a plug depending therefrom which is shaped to fit within the aperture, said depending plug fitting sealingly within said aperture when said cover member is in the closed position, (c) said fitment being so thin as to be accommodated within said 3- or 4-point rule score cartons and not requiring balancing means beyond said 3- or 4-point rule score lines and said glue flap to stack evenly said cartons.

* * * * *